US007124678B2

(12) United States Patent
Lee et al.

(10) Patent No.: US 7,124,678 B2
(45) Date of Patent: Oct. 24, 2006

(54) APPARATUS FOR PREVENTING ABRASION IN RECIPROCAL COMPRESSOR

(75) Inventors: Jong-Koo Lee, Gyeonggi-Do (KR); Gye-Young Song, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 69 days.

(21) Appl. No.: 10/968,153

(22) Filed: Oct. 20, 2004

(65) Prior Publication Data

US 2005/0142007 A1 Jun. 30, 2005

(30) Foreign Application Priority Data

Dec. 29, 2003 (KR) ..... 10-2003-0099279

(51) Int. Cl.
*F01B 9/00* (2006.01)
*F16J 1/10* (2006.01)

(52) U.S. Cl. ..... 92/140; 92/84; 417/417

(58) Field of Classification Search ..... 92/84, 92/129, 140, DIG. 4; 417/417
See application file for complete search history.

(56) References Cited

U.S. PATENT DOCUMENTS 4,416,594 A * 11/1983 Ichikawa ..... 417/417
4,939,952 A * 7/1990 Romer et al. ..... 92/140
5,442,993 A * 8/1995 Baliotti et al. ..... 92/84
5,485,777 A * 1/1996 Kim ..... 92/140
5,704,771 A * 1/1998 Fujisawa et al. ..... 417/417
6,174,141 B1 * 1/2001 Song et al. ..... 417/417
6,435,842 B1 * 8/2002 Song ..... 417/417
6,793,470 B1 * 9/2004 Song et al. ..... 417/417
6,863,506 B1 * 3/2005 Park et al. ..... 417/417

FOREIGN PATENT DOCUMENTS

JP 10-238461 A 9/1998

* cited by examiner

*Primary Examiner*—Edward K. Look
*Assistant Examiner*—Michael Leslie
(74) *Attorney, Agent, or Firm*—Birch, Stewart, Kolasch & Birch, LLP

(57) ABSTRACT

An apparatus for preventing abrasion in a reciprocal compressor, including a cylinder, a reciprocal motor having a stator and a mover, and generating a linear reciprocation driving force, a piston inserted into an inside space of the cylinder to be linearly movable, a piston rod coupled to the piston to be movable in the radial direction of the piston, and coupled to the mover of the reciprocal motor, for transmitting the linear reciprocation driving force of the reciprocal motor to the piston, and a concentricity control means coupled to a junction between the piston and the piston rod, for fixing the piston and the piston rod in the axial direction, and allowing a relative motion thereof in the radial direction. The apparatus prevents abrasion from being generated between the cylinder and the piston due to processing errors and assembly errors of components of the reciprocal compressor.

22 Claims, 5 Drawing Sheets

APPARATUS FOR PREVENTING ABRASION IN RECIPROCAL COMPRESSOR

This Nonprovisional application claims priority under 35 U.S.C. § 119(a) on Patent Application No(s). 10-2003-0099279 filed in Korea, Republic of on Dec. 29, 2003, the entire contents of which are hereby incorporated by reference.

BACKGROUND OF THE INVENTION

1. Field of the Invention

The present invention relates to a reciprocal compressor, and more particularly to, an apparatus for preventing abrasion in a reciprocal compressor which can prevent abrasion from being generated between a cylinder and a piston linearly reciprocating in an inside space of the cylinder due to processing errors and assembly errors of components of the reciprocal compressor.

2. Description of the Background Art

In general, a compressor transforms an electric energy into a kinetic energy, and compresses refrigerants by the kinetic energy. The compressor is one of the major components of a refrigeration cycle system, and classified into a rotary compressor, a scroll compressor and a reciprocal compressor according to a compression mechanism for compressing refrigerants.

FIG. 1 is a cross-sectional diagram illustrating the reciprocal compressor. Referring to FIG. 1, the reciprocal compressor includes a casing 100 having a gas suction tube 110 and a gas discharge tube 120, a frame unit 200 disposed in the casing 100, a reciprocal motor 300 mounted on the frame unit 200, for generating a linear reciprocation driving force, a compression unit 400 for receiving the driving force of the reciprocal motor 300, and compressing a gas, and a resonant spring unit 500 for resonating the driving force of the reciprocal motor 300.

The frame unit 200 includes a front frame 20 for supporting one side of the reciprocal motor 300, a middle frame 220 for supporting the other side of the reciprocal motor 300, and a rear frame 230 coupled to the middle frame 220, for forming a space with the middle frame 220.

The reciprocal motor 300 includes an outside stator 310 fixed between the middle frame 220 and the rear frame 230, an inside stator 320 inserted into the outside stator 310 and fixedly coupled to the front frame 210, a mover 330 movably inserted between the outside stator 310 and the inside stator 320, and a winding coil 340 coupled into the outside stator 310. The mover 330 is comprised of a magnet 331 and a magnet holder 332 for supporting the magnet 331.

The compression unit 400 includes a cylinder 410 fixedly coupled to the front frame 210, a piston 420 having its one side movably inserted into an inside space of the cylinder 410, and its other side fixedly coupled to the mover 330, a discharge valve assembly 430 mounted on one side of the cylinder 410, for controlling discharge of refrigerants, and a suction valve 440 mounted on the end of the piston 420, for controlling flow of refrigerants sucked to the inside space of the cylinder 410.

The piston 420 is comprised of a cylindrical body unit 421 having a predetermined length and outer diameter, a flange unit 422 extended from the end of the cylindrical body unit 421 in the vertical direction, the magnet holder 332 of the mover 330 being coupled to the flange unit 422, and a suction passage 423 formed in the cylindrical body unit 421.

The discharge valve assembly 430 includes a discharge cover 431 for covering the inside space of the cylinder 410, a discharge valve 432 inserted into the discharge cover 431, for opening/closing the inside space of the cylinder 410, and a discharge spring 433 inserted into the discharge cover 431, for elastically supporting the discharge valve 432.

The resonant spring unit 550 includes a spring support means 510 fixedly coupled with the piston 420 and the mover 330, a front coil spring 520 coupled between the spring support means 510 and the middle frame 220, and a rear coil spring 530 coupled between the spring support means 510 and the rear frame 230.

Reference numeral 10 denotes a support spring and 411 denotes the inside space of the cylinder 410.

The operation of the reciprocal compressor will now be explained.

When power is supplied to the reciprocal compressor, the linear reciprocation driving force is generated by an electromagnetic interaction of the reciprocal motor 300, and transmitted to the piston 420 through the mover 330.

The piston 420 receives the linear reciprocation driving force from the mover 330, and linearly reciprocates in the inside space 411 of the cylinder 410. The suction valve 440 and the discharge valve 432 are operated due to the linear reciprocation of the piston 420 and a pressure difference between the inside space 411 of the cylinder 410 and the outside, for sucking refrigerants to the inside space 411 of the cylinder 410, compressing the refrigerants and discharging the compressed refrigerants. The discharged refrigerants are discharged from the reciprocal compressor through the discharge cover 431 and the discharge tube 120. The refrigerants are compressed by repeating the above procedure.

The front coil spring 520 and the rear coil spring 530 are contracted or relaxed by the reciprocation of the mover 330 and the piston 420, for elastically supporting the mover 330 and the piston 420 and generating resonance.

On the other hand, in order to improve compression efficiency of the refrigerants compressed in the inside space 411 of the cylinder 410, the reciprocal compressor must precisely maintain an assembly tolerance between the inside space 411 of the cylinder 410 and the piston 420 inserted into the inside space 411 of the cylinder 410.

However, as described above, in the reciprocal compressor, the mover 330, the piston 420 and the resonant spring unit 500 are assembled as one assembly and coupled to the other components. If processing or assembly errors of the components occur during the processes for processing each component of the assembly and the processes for coupling the components, as shown in FIG. 2, concentricity of the inside space 411 of the cylinder 410 is not identical to that of the cylindrical body unit 421 of the piston 420, and thus the inner walls of the inside space 411 of the cylinder 410 contact the cylindrical body unit 421 of the piston 420. Accordingly, the cylinder 410 and the piston 420 are abraded and the compressed refrigerants are leaked, which results in low compression efficiency.

SUMMARY OF THE INVENTION

Therefore, an object of the present invention is to provide an apparatus for preventing abrasion in a reciprocal compressor which can prevent abrasion from being generated between a cylinder and a piston linearly reciprocating in an inside space of the cylinder due to processing errors and assembly errors of components of the reciprocal compressor.

To achieve these and other advantages and in accordance with the purpose of the present invention, as embodied and broadly described herein, there is provided an apparatus for preventing abrasion in a reciprocal compressor, including: a cylinder; a reciprocal motor having a stator and a mover, and generating a linear reciprocation driving force; a piston inserted into an inside space of the cylinder to be linearly movable; a piston rod coupled to the piston to be movable in the radial direction of the piston, and coupled to the mover of the reciprocal motor, for transmitting the linear reciprocation driving force of the reciprocal motor to the piston; and a concentricity control means coupled to a junction between the piston and the piston rod, for fixing the piston and the piston rod in the axial direction, and allowing a relative motion thereof in the radial direction.

According to another aspect of the present invention, an apparatus for preventing abrasion in a reciprocal compressor includes: a first cylinder; a reciprocal motor having a stator and a mover, and generating a linear reciprocation driving force; a first piston coupled to the mover of the reciprocal motor, for linearly reciprocating in an inside space of the first cylinder by the linear reciprocation driving force of the reciprocal motor; a second cylinder coupled to the first piston to be linked to a first suction passage formed in the first piston; a second piston inserted into an inside space of the second cylinder to be linearly movable; a piston rod coupled to the second piston to be movable in the radial direction of the second piston, and fixedly coupled to a frame, and a concentricity control means coupled to a junction between the second piston and the piston rod, for fixing the second piston and the piston rod in the axial direction, and allowing a relative motion thereof in the radial direction.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus for preventing abrasion in a reciprocal compressor in accordance with the present invention will now be explained in detail with reference to the accompanying drawings.

Figure 1:
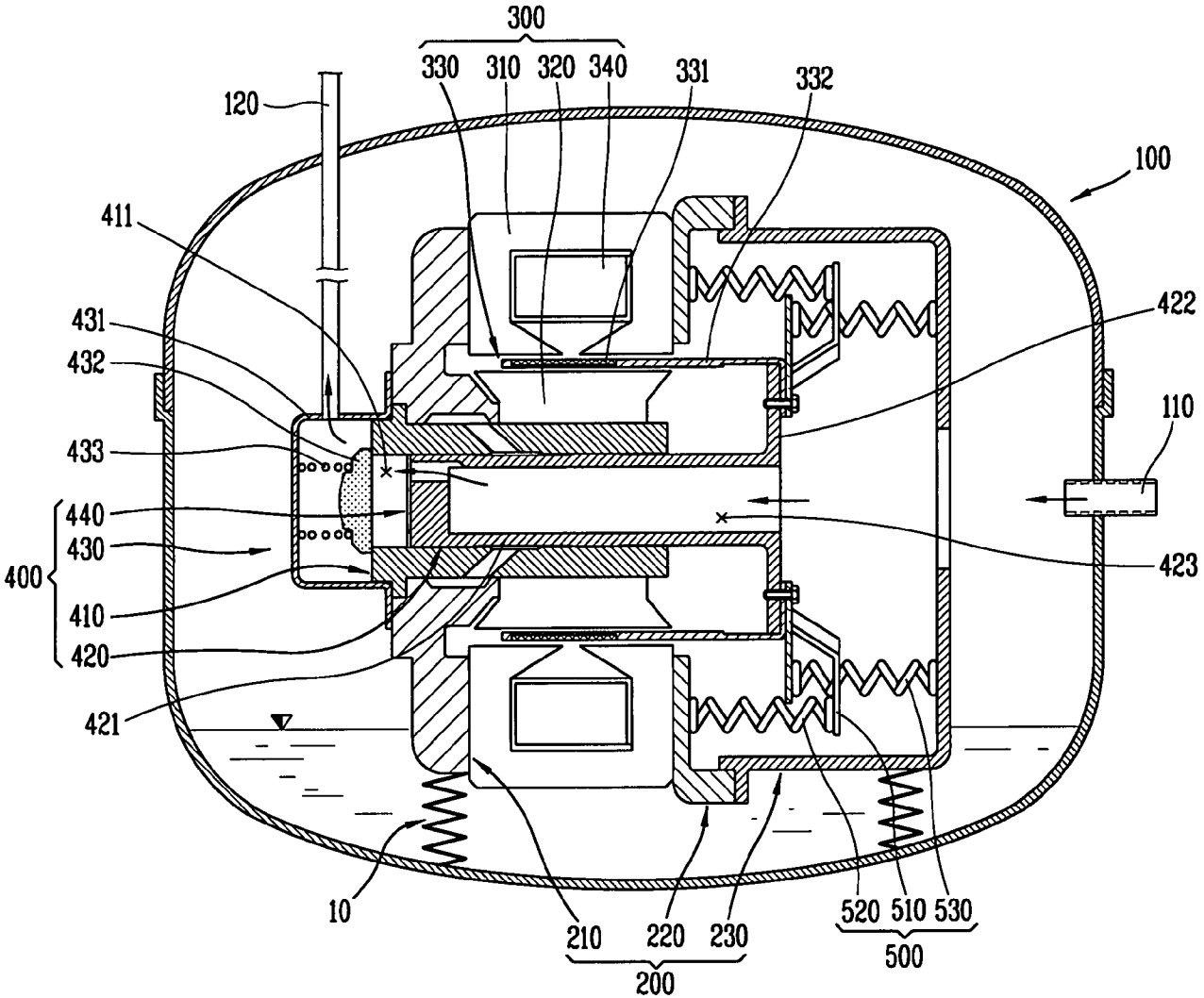
FIG. 1 CONVENTIONAL ART
FIG. 1 is a cross-sectional diagram illustrating a conventional reciprocal compressor.
Figure 2:
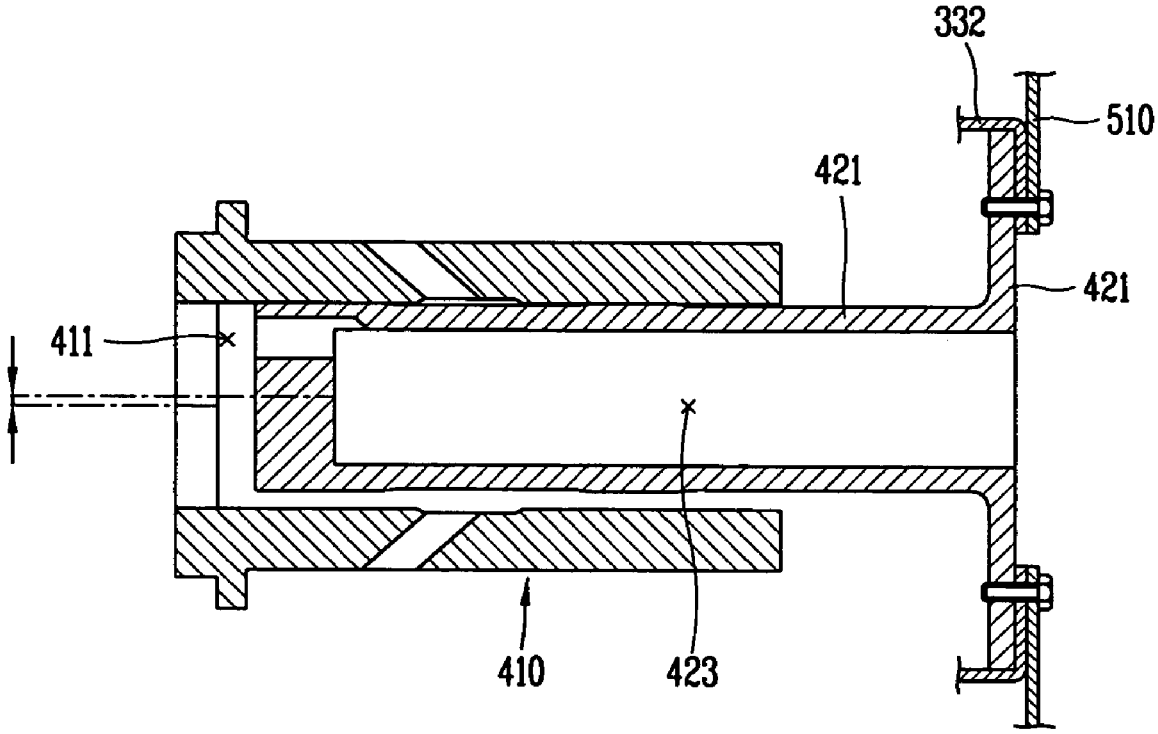
FIG. 2 CONVENTIONAL ART
FIG. 2 is a cross-sectional diagram illustrating abrasion between a cylinder and a piston of the conventional reciprocal compressor.
Figure 3:
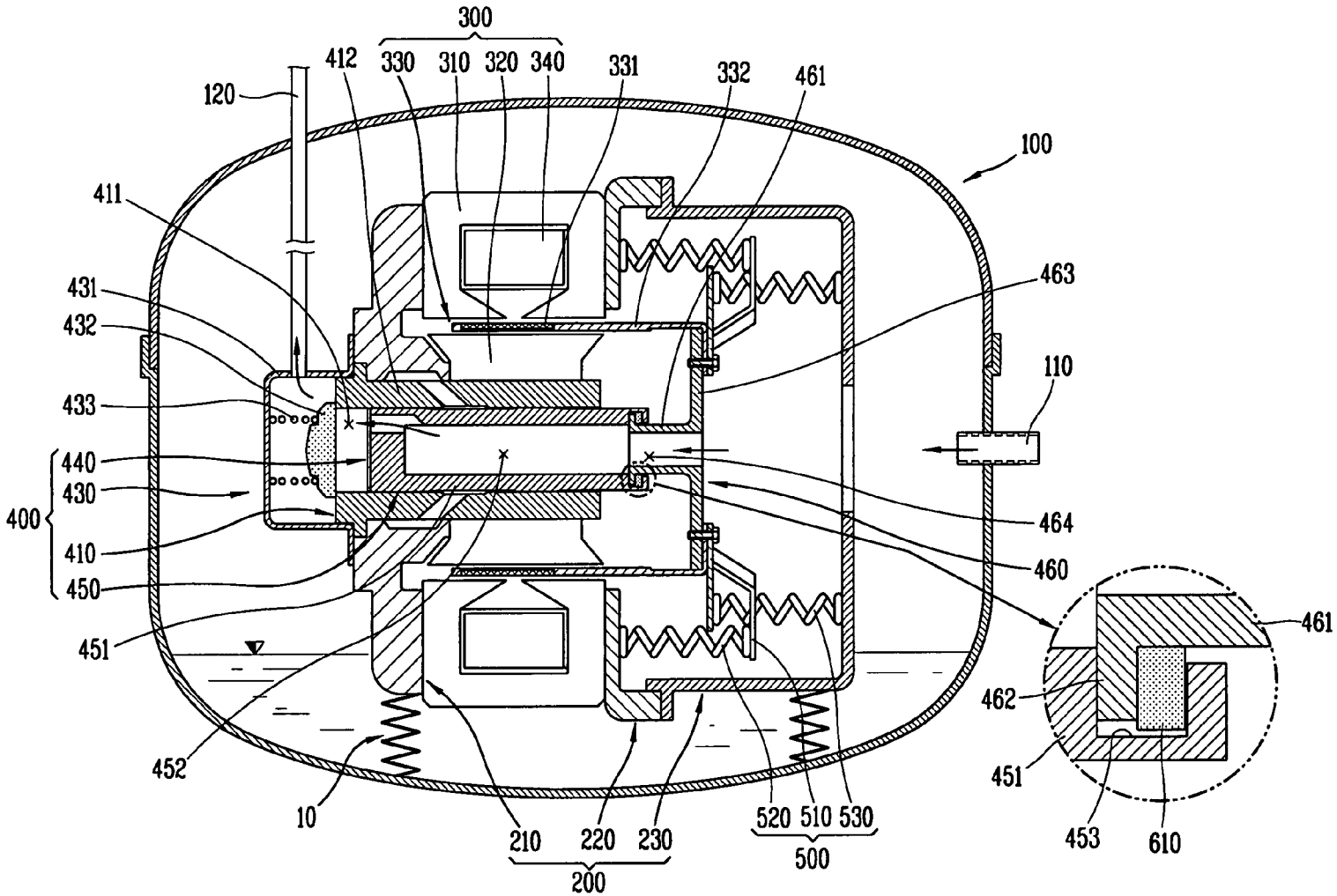
FIG. 3 is a cross-sectional diagram illustrating a reciprocal compressor including an apparatus for preventing abrasion in the reciprocal compressor in accordance with a first embodiment of the present invention.

FIG. 3 is a cross-sectional diagram illustrating a reciprocal compressor including an apparatus for preventing abrasion in the reciprocal compressor in accordance with a first embodiment of the present invention. Wherever possible, the same reference numerals will be used throughout the drawings and the description to refer to the same or like parts.

As illustrated in FIG. 3, the reciprocal compressor includes a casing 100 having a gas suction tube 110 and a gas discharge tube 120, a frame unit 200 disposed in the casing 100, a reciprocal motor 300 mounted on the frame unit 200, for generating a linear reciprocation driving force, a compression unit 400 having the apparatus for preventing abrasion, receiving the driving force of the reciprocal motor 300, and compressing a gas, and a resonant spring unit 500 for resonating the driving force of the reciprocal motor 300.

The casing 100, the frame unit 200 and the resonant spring unit 500 are identical to the conventional ones, and thus detailed explanations thereof are omitted.

The reciprocal motor 300 includes an outside stator 310 fixed between the middle frame 220 and the rear frame 230, an inside stator 320 inserted into the outside stator 310 and fixedly coupled to the front frame 210, a mover 330 movably inserted between the outside stator 310 and the inside stator 320, and a winding coil 340 coupled into the outside stator 310. The mover 330 is comprised of a magnet 331 and a magnet holder 332 for supporting the magnet 331.

The compression unit 400 includes a cylinder 410 fixedly coupled to the front frame 210, a piston 450 inserted into an inside space 411 of the cylinder 410 to be linearly movable, a piston rod 460 coupled to the piston 450 to be movable in the radial direction of the piston 450, and coupled to the mover 330, for transmitting the linear reciprocation driving force of the reciprocal motor 300 to the piston 450, a concentricity control means coupled to a junction between the piston 450 and the piston rod 460, for fixing the piston 450 and the piston rod 460 in the axial direction, and allowing a relative motion thereof in the radial direction, a discharge valve assembly 430 mounted on one side of the cylinder 410, for controlling discharge of refrigerants, and a suction valve 440 mounted on the end of the piston 420, for controlling flow of refrigerants sucked to the inside space 411 of the cylinder 410.

The cylinder 410 includes a cylinder body 412 formed in a predetermined shape, and the inside space 411 formed in a cylindrical shape in the cylinder body 412.

The discharge valve assembly 430 includes a discharge cover 431 for covering one side of the cylinder body 412, a discharge valve 432 inserted into the discharge cover 431, for opening/closing one side of the inside space 411, and a valve spring 433 inserted into the discharge cover 431, for elastically supporting the discharge valve 432.

The piston 450 includes a piston body unit 451 having a predetermined length and outer diameter, a suction passage 452 formed in the piston body unit 451 in the length direction, and an insertion groove 453 formed on an one side inner wall of the suction passage 452 with a predetermined width and depth. The suction valve 440 is coupled to the end of the piston body unit 451 positioned in the opposite side to the insertion groove 453. The piston 450 is inserted into the inside space 411 of the cylinder 410, and the suction valve 440 coupled to the piston 450 is disposed in the inside space 411 of the cylinder 410.

The piston rod 460 includes a rod body unit 461 having a predetermined outer diameter and length, a ring-shaped hooking protrusion unit 462 protruded from one side outer circumferential surface of the rod body unit 461 with a predetermined height and thickness (width), a flange unit 463 formed on the other side outer circumferential surface of the rod body unit 461 with a predetermined thickness and area, and a suction passage 464 formed in the rod body unit 461 in the length direction. An outer diameter and a thickness of the hooking protrusion unit 462 are smaller than an inner diameter and a width of the insertion groove 453. In the piston rod 460, the hooking protrusion unit 462 is inserted and hooked onto the insertion groove 453, and the magnet holder 332 of the mover 330 and a spring support means 510 of the resonant spring unit 500 are fixedly coupled to the flange unit 463 by a plurality of bolts.

The concentricity control means is coupled between one side of the insertion groove 453 of the piston 450 and one side of the hooking protrusion unit 462 of the piston rod 460 facing one side of the insertion groove 453.

The concentricity control means includes a ring-shaped elastic body 610 having a predetermined thickness. The elastic body 610 is coupled between the rear surface of the hooking protrusion unit 462 and one side of the insertion groove 453, which is the opposite side to a compression stroke direction. The elastic body 610 restricts an axial motion of the piston 450 and the piston rod 460, and allows a radial relative motion thereof.

Figure 4:
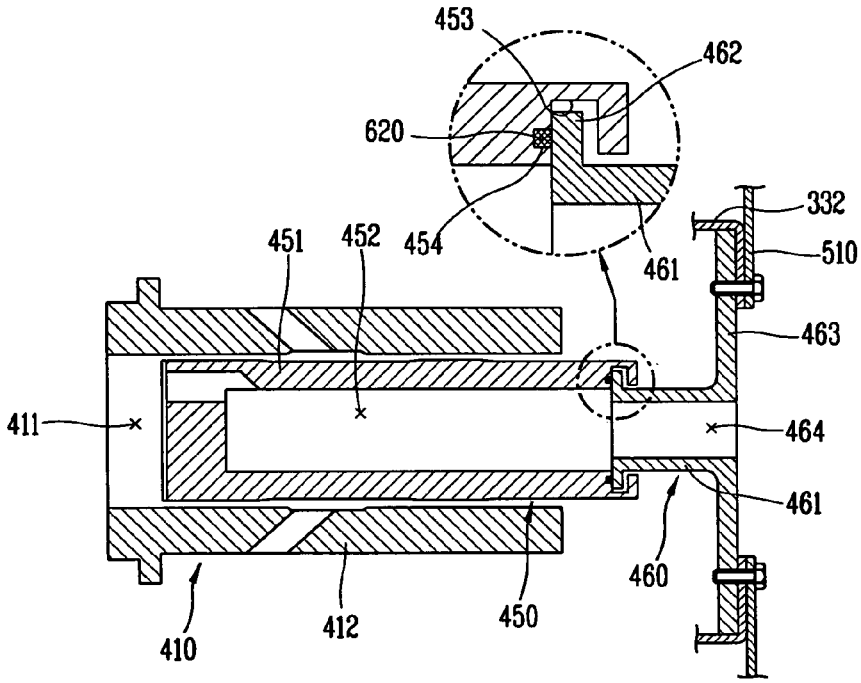
FIGS. 4 and 5 are cross-sectional diagrams illustrating examples of a concentricity control means of the apparatus for preventing abrasion in the reciprocal compressor in accordance with the present invention.

FIG. 4 shows another example of the concentricity control means. A ring-shaped magnet 620 having a predetermined thickness is used as the concentricity control means.

A coupling groove 454 corresponding to the ring-shaped magnet 620 is formed at one side of the insertion groove 453 of the piston 450, and the ring-shaped magnet 620 is fixedly coupled to the coupling groove 454. The coupling groove 454 is formed at one side of the insertion groove 453 facing the front surface of the hooking protrusion unit 462 of the piston rod 460. The magnet 620 fixes the piston 450 and the piston rod 460 in the axial direction, and allows a relative motion thereof in the radial direction.

Figure 5:
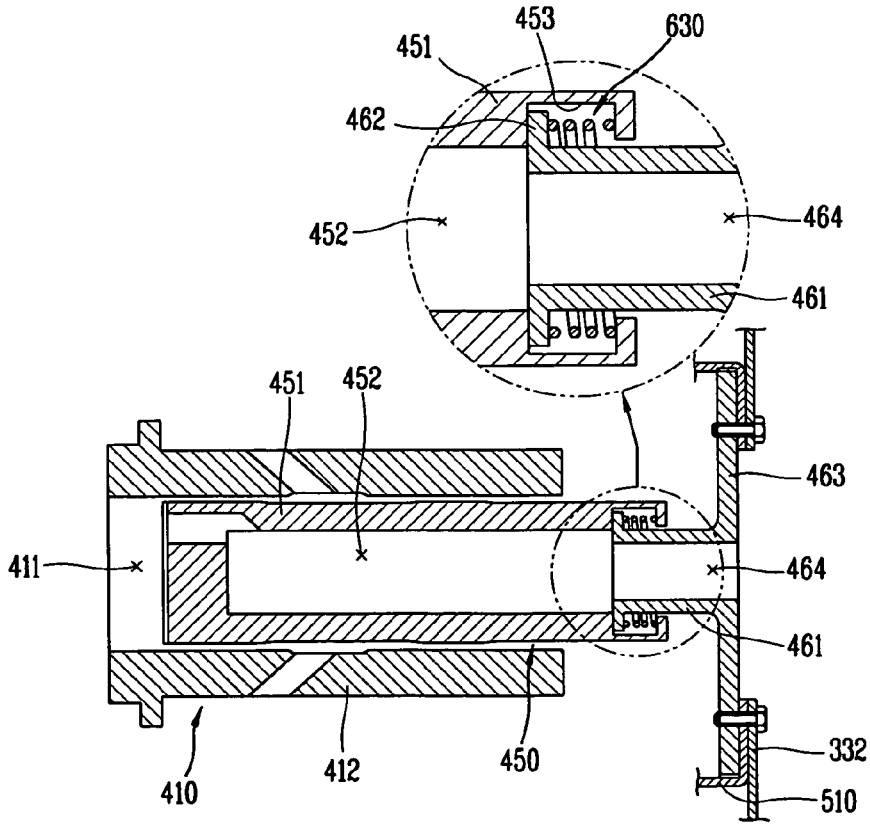

FIG. 5 shows yet another example of the concentricity control means. A compression coil spring 630 is used as the concentricity control means.

The compression coil spring 630 is coupled between the rear surface of the hooking protrusion unit 462 and one side of the insertion groove 453 facing the rear surface of the hooking protrusion unit 462. That is, the compression coil spring 630 is positioned in the opposite side to the compression stroke direction of the piston 450. An outer diameter of the compression coil spring 630 is smaller than that of the hooking protrusion unit 462.

The compression coil spring 630 restricts an axial motion of the piston 450 and the piston rod 460, and allows a radial relative motion thereof.

The operation of the apparatus for preventing abrasion in the reciprocal compressor in accordance with the present invention will now be described.

When the linear reciprocation driving force of the reciprocal motor 300 is transmitted to the piston 450 through the piston rod 460 coupled to the mover 330, the piston 450 linearly reciprocates in the inside space 411 of the cylinder 410.

When the piston 450 moves from the top dead center to the bottom dead center, the suction valve 440 is opened and the discharge valve 432 is closed due to a pressure difference between the inside space 411 of the cylinder 410 and the outside, so that the refrigerants can be sucked to the inside space 411 of the cylinder 410 through the suction passages 452 and 464. The hooking protrusion unit 462 of the piston rod 460 is hooked on the insertion groove 453 of the piston 450, and thus the piston rod 460 pulls the piston 450. The concentricity control means disposed between the piston rod 460 and the piston 450 fixes or restricts the axial motion of the piston 450 and the piston rod 460.

When the piston 450 moves from the bottom dead center to the top dead center, the suction valve 440 is closed, and the gas sucked to the inside space 411 of the cylinder 410 is compressed. In a predetermined pressurized state, the discharge valve 432 is opened to discharge the compressed gas. In addition, the front surface of the hooking protrusion unit 462 of the piston rod 460 pushes one side of the insertion groove 453 of the piston 450. The concentricity control means disposed between the piston rod 460 and the piston 450 fixes or restricts an axial motion of the piston 450 and the piston rod 460.

On the other hand, in the case that assembly errors are accumulated by processing errors and assembly errors of the mover 330 of the reciprocal motor 300, the piston rod 460 coupled to the mover 330, and the piston 450, the piston 450, the piston rod 460 can move in the radial direction and compensate for the accumulated errors, thereby maintaining the concentricity of the piston 450 and the inside space 411 of the cylinder 410. That is, the concentricity control means fixes or restricts an axial motion of the piston 450 and the piston rod 460, and allows a radial motion thereof. Accordingly, even if errors are accumulated between the components, the concentricity of the inside space 411 of the cylinder 410 and the piston 450 can be always maintained.

Figure 6:
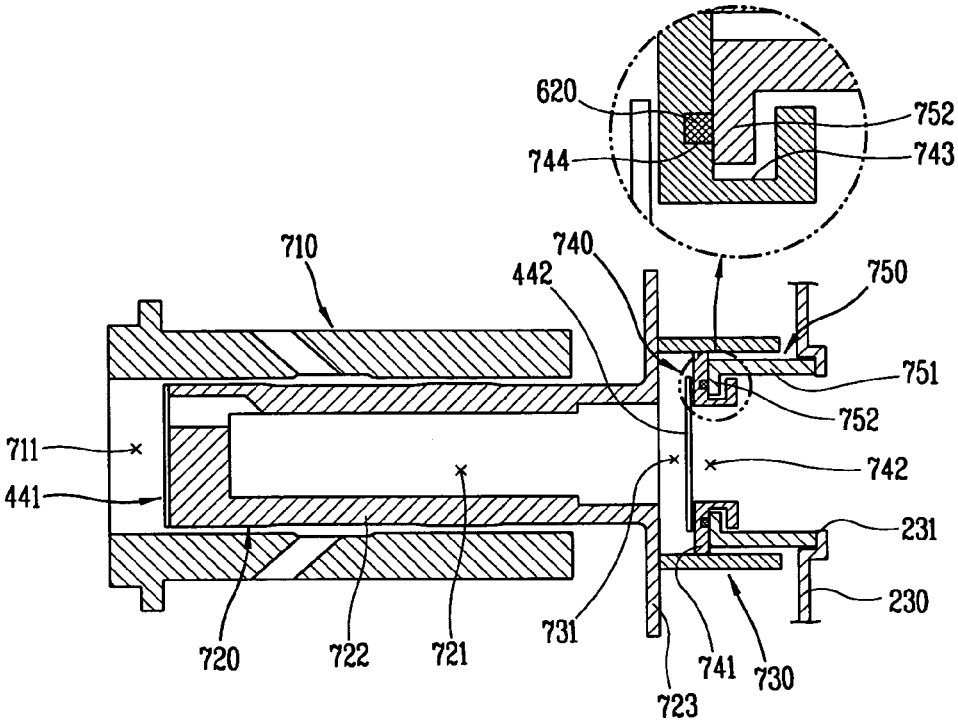
FIGS. 6 and 7 are cross-sectional diagrams illustrating an apparatus for preventing abrasion in a reciprocal compressor in accordance with second and third embodiments of the present invention.

FIG. 6 is a cross-sectional diagram illustrating an apparatus for preventing abrasion in a reciprocal compressor in accordance with a second embodiment of the present invention. In the following description, same reference numerals are used for the same elements as those of the first embodiment of the present invention.

Referring to FIG. 6, the apparatus for preventing abrasion in the reciprocal compressor includes a first cylinder 710, a reciprocal motor (300; refer to FIG. 3) for generating a linear reciprocation driving force, a first piston 720 coupled to a mover 330 of the reciprocal motor 300, for linearly reciprocating in an inside space 711 of the first cylinder 710 by the driving force of the reciprocal motor 300, a second cylinder 730 coupled to the first piston 720 to be linked to a first suction passage 721 formed in the first piston 720, a second piston 740 inserted into an inside space 731 of the second cylinder 730, a piston rod 750 coupled to the second piston 740 to be movable in the radial direction of the second piston 740, and fixedly coupled to a rear frame 230, and a concentricity control means coupled to a junction between the second piston 740 and the piston rod 750, for fixing the second piston 740 and the piston rod 750 in the axial direction, and allowing a radial motion thereof.

A discharge valve assembly (430; refer to FIG. 3) is disposed at one side of the first cylinder 710, and the reciprocal motor 300 has been described above.

The first piston 720 includes a piston body unit 722 having a predetermined length and outer diameter, a suction passage 721 formed in the piston body unit 722 in the length direction, and a flange unit 723 extended from one side outer circumferential surface of the piston body unit 722 with a predetermined thickness and area. A first suction valve 441 is mounted on the end surface of the piston body unit 722 positioned in the opposite side to the flange unit 723, and the first piston 720 is inserted so that the mounting portion of the first suction valve 441 can be positioned in the inside space 711 of the first cylinder 710.

The second cylinder 730 is formed in a cylindrical shape and coupled to the flange unit 723 of the first piston 720. The inside space 731 of the second cylinder 730 is linked to the suction passage 721 of the first piston 720.

The second piston 740 includes a piston body unit 741 having an outer diameter corresponding to an inner diameter of the inside space 731 of the second cylinder 730 and a predetermined length, a suction passage 742 formed in the piston body unit 741, and an insertion groove 743 formed at the outside of one side of the piston body unit 741. A second suction valve 442 for opening/closing the suction passage 742 is mounted on one surface of the piston body unit 741 positioned in the opposite side to the insertion groove 743. The second piston 740 is inserted into the inside space 731 of the second cylinder 730 so that the second suction valve 442 can be positioned near the flange unit 723 of the first piston 720.

The piston rod 750 includes a cylinder unit 751 having a predetermined length and outer diameter, and a ring-shaped hooking protrusion unit 752 formed on one side inner circumferential surface of the cylinder unit 751 with a predetermined thickness and height. An outer diameter of the cylinder unit 751 is smaller than an inner diameter of the inside space 731 of the second cylinder 730, and an outer diameter of the insertion groove 743 is larger than an inner diameter of the hooking protrusion unit 752. The hooking protrusion unit 752 of the piston rod 750 is inserted into the insertion groove 743 of the second piston 740, and one side of the piston rod 750 is fixedly coupled to the rear frame 230 composing a frame unit. A through hole 231 linked to the inside of the piston rod 750 is formed on the rear frame 230 to which the piston rod 750 is coupled.

The concentricity control means is coupled between one side of the insertion groove 743 of the second piston 740 and one side of the hooking protrusion unit 752 of the piston rod 750 facing one side of the insertion groove 743.

The concentricity control means is a ring-shaped magnet 620 having a predetermined thickness and outer diameter. A coupling groove 744 corresponding to the ring-shaped magnet 620 is formed at one side of the insertion groove 743, and the magnet 620 is coupled to the coupling groove 744.

As another example, an elastic body or a compression coil spring can be used as the concentricity control means, which has been described above.

The operation of the apparatus for preventing abrasion in the reciprocal compressor in accordance with the present invention will now be described.

When the linear reciprocation driving force of the reciprocal motor 300 is transmitted to the first piston 720 coupled to the mover 330, the first piston 720 linearly reciprocates in the inside space 711 of the first cylinder 710.

When the first piston 720 moves from the top dead center to the bottom dead center, the first suction valve 441 is opened and the second suction valve 442 is closed due to a pressure difference between the inside space 711 of the first cylinder 710 and the outside, so that the refrigerants sucked to the suction passage 721 of the first piston 720 and the inside space 731 of the second cylinder 730 can be sucked to the inside space 711 of the first cylinder 710. As the second cylinder 730 moves with the first piston 720, the second cylinder 730 and the second piston 740 perform a relative motion. The concentricity control means fixes or restricts an axial motion of the second piston 740 and the piston rod 750, and allows a radial motion thereof.

When the first piston 720 moves from the bottom dead center to the top dead center, the first suction valve 441 is closed, and the gas sucked to the inside space 711 of the first cylinder 710 is compressed. In a predetermined pressurized state, the discharge valve 432 is opened to discharge the compressed gas. At the same time, as the second cylinder 730 moves with the first piston 720, the second suction valve 442 is opened to suck the refrigerants to the suction passage 711 of the first piston 710 and the inside space 731 of the second cylinder 730. In this process, the concentricity control means fixes or restricts an axial motion of the second piston 740 and the piston rod 750, and allows a radial motion thereof.

In the apparatus for preventing abrasion in the reciprocal compressor, when assembly errors are accumulated by processing errors and assembly errors of the components, the second piston 740 and the piston rod 750 can move in the radial direction and compensate for the accumulated errors, thereby maintaining the concentricity of the second piston 740 and the inside space 731 of the second cylinder 730.

Figure 7:
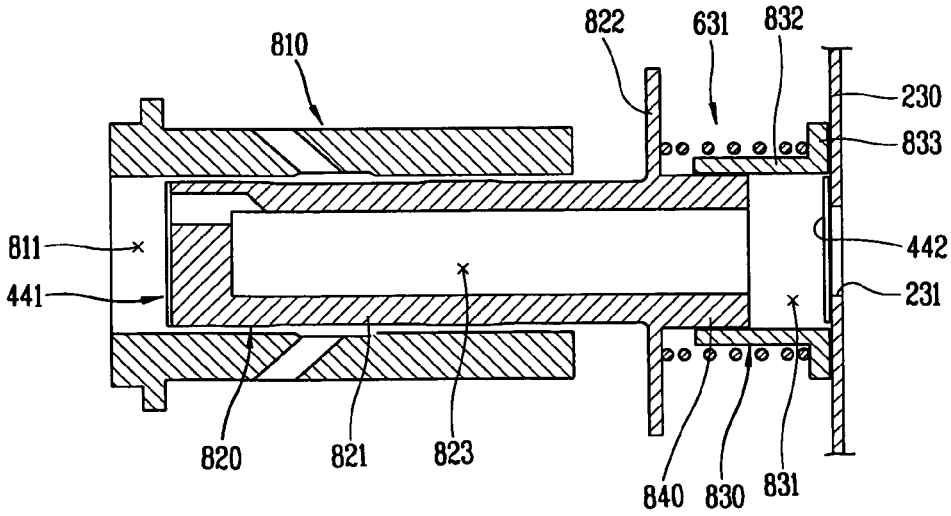

FIG. 7 is a cross-sectional diagram illustrating an apparatus for preventing abrasion in a reciprocal compressor in accordance with a third embodiment of the present invention. In the following description, same reference numerals are used for the same elements as those of the first embodiment of the present invention.

As illustrated in FIG. 7, the apparatus for preventing abrasion in the reciprocal compressor includes a first cylinder 810, a reciprocal motor (300; refer to FIG. 3) for generating a linear reciprocation driving force, a first piston 820 coupled to a mover 330 of the reciprocal motor 300, for linearly reciprocating in an inside space 811 of the first cylinder 810 by the linear reciprocation driving force of the reciprocal motor 300, a rear frame 230 disposed at a predetermined interval from the first piston 820, a second cylinder 830 disposed between the rear frame 230 and the first piston 820, a second piston 840 extended from one side of the first piston 820, and movably inserted into an inside space 831 of the second cylinder 830, and a concentricity control means for fixing the second cylinder 830 in the axial direction, and allowing the second cylinder 830 to perform a radial relative motion on the rear frame 230.

A discharge valve assembly (430; refer to FIG. 3) is coupled to one side of the first cylinder 810, and the reciprocal motor 300 has been described above.

The first piston 820 includes a piston body unit 821 having a predetermined length and outer diameter, a flange unit 822 extended from one side outer circumferential surface of the piston body unit 821 with a predetermined thickness and area, a second piston 840 formed on one surface of the flange unit 822 with a predetermined outer diameter and length, and a suction passage 823 formed in the piston body unit 821 and the second piston 840. A first suction valve 441 for opening/closing the suction passage 823 is mounted on the end surface of the piston body unit 821. The first piston 820 is inserted so that the mounting portion of the first suction valve 441 can be positioned in the inside space 811 of the first cylinder 810.

The second cylinder 830 includes a cylinder unit 832 having a hollow space, and a ring-shaped support unit 833 extended from one side outer circumferential surface of the cylinder unit 832 at a predetermined thickness and area. The support unit 833 of the second cylinder 830 is supported by contacting the rear frame 230, and the second piston 840 is inserted into the cylinder unit 832 of the second cylinder 830. A through hole 231 is formed on the rear frame 230 to be linked to the inside space 831 of the second cylinder 830, and a second suction valve 442 for opening/closing the through hole 231 is mounted on the rear frame 230 to be disposed in the inside space 831 of the second cylinder 830.

The concentricity control means is a coil spring 631, and coupled between the support unit 832 of the second cylinder 830 and the flange unit 822 of the first piston 820.

As another example, an elastic body or a magnet coupled between the second cylinder 830 and the rear frame 230 can be used as the concentricity control means, which has been described above.

The operation of the apparatus for preventing abrasion in the reciprocal compressor in accordance with the present invention will now be described.

When the linear reciprocation driving force of the reciprocal motor 300 is transmitted to the first piston 820 coupled to the mover 330, the first piston 820 linearly reciprocates in the inside space 811 of the first cylinder 810.

When the first piston 820 moves from the top dead center to the bottom dead center, the first suction valve 441 is opened and the second suction valve 442 is closed due to a pressure difference between the inside space 811 of the first cylinder 810 and the outside, so that the refrigerants sucked to the suction passage 823 of the first piston 820 and the inside space 831 of the second cylinder 830 can be sucked to the inside space 811 of the first cylinder 810. As the second piston 840 moves with the first piston 820, the second piston 840 and the second cylinder 830 perform a relative motion. The concentricity control means fixes the second cylinder 830 in the axial direction, and allows a radial motion thereof.

When the first piston 820 moves from the bottom dead center to the top dead center, the first suction valve 441 is closed, and the gas sucked to the inside space 811 of the first cylinder 810 is compressed. In a predetermined pressurized state, the discharge valve 432 is opened to discharge the compressed gas. At the same time, as the second piston 840 moves with the first piston 820, the second suction valve 442 is opened to suck the refrigerants to the suction passage 823 of the first piston 820 and the inside space 831 of the second cylinder 830. In this process, the concentricity control means, namely the coil spring 631 fixes the second cylinder 830 in the axial direction, and allows a radial motion thereof.

In the apparatus for preventing abrasion in the reciprocal compressor, when assembly errors are accumulated by processing errors and assembly errors of the components, the second cylinder 830 can perform a relative motion on the rear frame 230 and compensate for the accumulated errors, thereby maintaining the concentricity of the inside space 831 of the second cylinder 830 and the second piston 840.

As discussed earlier, in accordance with the present invention, when assembly errors are accumulated by processing errors and assembly errors of the components of the reciprocal compressor, the apparatus for preventing abrasion in the reciprocal compressor prevents abrasion from being generated due to eccentricity between the cylinder and the piston, by compensating for the accumulated errors and maintaining the concentricity between the cylinder and the piston. As a result, reliability and compression efficiency of the reciprocal compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for preventing abrasion in a reciprocal compressor, comprising:

a cylinder;

a reciprocal motor having a stator and a mover, and generating a linear reciprocation driving force;

a piston inserted into an inside space of the cylinder to be linearly movable;

a piston rod coupled to the piston to be movable in the radial direction of the piston, and coupled to the mover of the reciprocal motor, for transmitting the linear reciprocation driving force of the reciprocal motor to the piston; and a concentricity control means coupled to a junction between the piston and the piston rod, for fixing the piston and the piston rod in the axial direction, and allowing a relative motion thereof in the radial direction.

2. The apparatus of claim 1, wherein a suction passage for sucking refrigerants to the inside space of the cylinder is formed in the piston and the piston rod, and a suction valve is coupled to the end of the piston to be disposed in the inside space of the cylinder.

3. The apparatus of claim 1, wherein a resonant spring unit for resonating motions of the mover and the piston is coupled to the piston rod.

4. The apparatus of claim 1, wherein the piston and the piston rod comprise concave and convex parts, the concave and convex parts are hooked in the motion direction of the piston, and the concentricity control means is coupled between the surfaces of the concave and convex parts facing each other in the motion direction of the piston.

5. The apparatus of claim 4, wherein the concentricity control means is a ring-shaped elastic body having a predetermined thickness.

6. The apparatus of claim 5, wherein the elastic body is positioned in the opposite side to a compression stroke direction.

7. The apparatus of claim 4, wherein the concentricity control means is a ring-shaped magnet having a predetermined thickness.

8. The apparatus of claim 7, wherein a ring-shaped coupling groove is formed in the piston on the piston rod side, and the ring-shaped magnet is inserted into the coupling groove.

9. The apparatus of claim 4, wherein the concentricity control means is a compression coil spring.

10. The apparatus of claim 9, wherein the compression coil spring is positioned in the opposite side to a compression stroke direction.

11. The apparatus of claim 1, wherein at least one of the piston and the piston rod includes a groove and the other of the at least one of the piston and the piston rod includes a projection, wherein the projection extends into the groove.

12. The apparatus of claim 11, wherein the piston includes the groove and the projection extends outward from the piston body.

13. The apparatus of claim 1, wherein the piston rod is in direct contact with the piston during a portion when transmitting the linear reciprocation driving force.

14. The apparatus of claim 1, wherein the piston includes a groove and the piston rod includes a flange, wherein the flange of the piston rod is disposed in the groove.

15. An apparatus for preventing abrasion in a reciprocal compressor, comprising:

a first cylinder;

a reciprocal motor having a stator and a mover, and generating a linear reciprocation driving force;

a first piston coupled to the mover of the reciprocal motor, for linearly reciprocating in an inside space of the first cylinder by the linear reciprocation driving force of the reciprocal motor;

a second cylinder coupled to the first piston to be connected to a first suction passage formed in the first piston;

a second piston inserted into an inside space of the second cylinder to be linearly movable;

a piston rod coupled to the second piston to be movable in the radial direction of the second piston, and fixedly coupled to a frame; and a concentricity control means coupled to a junction between the second piston and the piston rod, for fixing the second piston and the piston rod in the axial direction, and allowing a relative motion thereof in the radial direction.

16. The apparatus of claim 15, wherein the second piston and the piston rod comprise concave and convex parts, the concave and convex parts are hooked in the motion direction of the second piston, and the concentricity control means is coupled between the surfaces of the concave and convex parts facing each other in the motion direction of the second piston.

17. The apparatus of claim 16, wherein the concentricity control means is a ring-shaped elastic body having a predetermined thickness.

18. The apparatus of claim 17, wherein the elastic body is positioned in the opposite side to a compression stroke direction.

19. The apparatus of claim 16, wherein the concentricity control means is a ring-shaped magnet having a predetermined thickness.

20. The apparatus of claim 19, wherein a ring-shaped coupling groove is formed in the second piston on the piston rod side, and the ring-shaped magnet is inserted into the coupling groove.

21. An apparatus for preventing abrasion in a reciprocal compressor, comprising:

a first cylinder;

a reciprocal motor having a stator and a mover, and generating a linear reciprocation driving force;

a first piston coupled to the mover of the reciprocal motor, for linearly reciprocating in an inside space of the first cylinder by the linear reciprocation driving force of the reciprocal motor;

a frame having a suction valve and being disposed at a predetermined interval from the first piston;

a second cylinder disposed between the frame and the first piston to be connected to a suction passage formed in the first piston and to be linearly movable in the radial direction;

a second piston extended from one side of the first piston, and movably inserted into an inside space of the second cylinder; and a concentricity control means for fixing the second cylinder in the axial direction, and allowing the second cylinder to perform a relative motion on the frame.

22. The apparatus of claim 21, wherein the concentricity control means is a coil spring coupled between the second cylinder and the first piston.

* * * * *